US007380663B2

(12) United States Patent
Bingham et al.

(10) Patent No.: US 7,380,663 B2
(45) Date of Patent: Jun. 3, 2008

(54) MULTIPLE USE RETAIL AND HOSPITALITY TYPE CARD WITH LONGITUDINALLY AND TRANSVERSELY DISPOSED INDENTATIONS

(75) Inventors: Mark R. Bingham, Mt. Vernon, OH (US); Brian W. Webb, Howard, OH (US)

(73) Assignee: Ward/Kraft, Inc., Fort Scott, KS (US)

( * ) Notice: Subject to any disclaimer, the term of this patent is extended or adjusted under 35 U.S.C. 154(b) by 508 days.

(21) Appl. No.: 11/197,795

(22) Filed: Aug. 5, 2005

(65) Prior Publication Data

US 2007/0114152 A1 May 24, 2007

(51) Int. Cl.
*B65D 73/00* (2006.01)

(52) U.S. Cl. ..... 206/460; 206/39; 206/449; D19/9; D19/10

(58) Field of Classification Search ..... 206/39, 206/39.5, 232, 449, 460; D19/1–12, 65, D19/99, 100; 283/74, 75, 76, 81, 82, 83, 283/109, 904; 235/380
See application file for complete search history.

(56) References Cited

U.S. PATENT DOCUMENTS

D17,308 S * 5/1887 Kelsey ..... D19/1
2,225,297 A * 12/1940 Conner ..... 101/369
D138,733 S * 9/1944 Pollack ..... D11/95
D175,829 S * 10/1955 Fitzpatrick ..... D19/1
D386,524 S * 11/1997 Walker ..... D19/34
5,713,406 A * 2/1998 Drury ..... 150/132
5,740,915 A * 4/1998 Williams ..... 206/555
5,825,005 A * 10/1998 Behnke ..... 235/380
6,224,108 B1 * 5/2001 Klure ..... 283/74
6,543,809 B1 * 4/2003 Kistner et al. ..... 283/57
D496,459 S * 9/2004 Glaesel ..... D24/147
2006/0271069 A1 * 11/2006 Glaesel ..... 606/131

* cited by examiner

*Primary Examiner*—David T Fidei
(74) *Attorney, Agent, or Firm*—Michael C. Maier

(57) ABSTRACT

The present invention relates to a hospitality type card which is provided with a series of indentations on each of its first and second longitudinally extending sides and first and second transversely extending edges that are sized and configured so as to be graspable by digits of a human hand. The card may further include indentations on each of the first and second transversely extending edges to accommodate additional graspable orientations as well as add aesthetic attributes to the card structure. The card may be provided with a card carrier which may be printed with matching or complimentary indicia as well as personalized indicia directed at a recipient of the card and carrier.

20 Claims, 4 Drawing Sheets

MULTIPLE USE RETAIL AND HOSPITALITY TYPE CARD WITH LONGITUDINALLY AND TRANSVERSELY DISPOSED INDENTATIONS

CROSS-REFERENCES TO RELATED APPLICATIONS

None.

FIELD OF THE INVENTION

The present invention is directed to the field of semi-rigid, substantially planar substrates, namely plastic card type products that are commonly used in the retail and hospitality industries for gift and debit cards, entrance cards and souvenir remembrance articles. The card that is utilized in the current application has a series of strategically placed indentations that are provided around the periphery of the substrate such that the card may be easily graspable by the digits of the human hand in order that the card may be held securely in one's hand. The indentations on the longitudinally extending sides are positioned so as to readily accommodate the spacing of thumb and fingers so that the card can be easily manipulated and positioned such as may be required to place the card into a payment processing system, an entry or key slot for a door, passageway or other entry.

BACKGROUND OF THE INVENTION

Cards, including plastic and laminated cards and tags, are generally well known and come in a variety of sizes and shapes depending on the particular needs of the issuer or end user. Wallet sized cards have become fairly common place and due to the popularity of such cards, the products have been used for identification cards, credit card, key cards and a host of other applications. Wallet sized cards have a size of about 3⅜ inches wide to 2⅛ inches in length.

Gift cards have also become fairly regularly used and may often be provided with colorful graphics and included along with a greeting card or other presentation vehicle which may similarly contain graphics and pictorial representations of the gift giving event that accompanies the exchange of the card product. The card may be placed loosely within the card, held in place by a spot of adhesive, have some cut outs to hold corners of the card or may use some other means to hold the card that does not detract from the appearance of the overall gift package.

Hospitality cards, such as those used in clubs, hotels, restaurants and the like often may have some rudimentary generic or static printing provided on a first surface and a magnetic stripe provided on the back surface. The magnetic stripe is more than likely used to help in gaining access to the establishment such as by opening a door or other entryway.

There are many types and forms used to carry cards in addition to gift cards referenced above. One traditional means used to deliver cards was to place the card in a carrier that had cut out notches to receive two or more corners of the card and then deliver the card through the mail, by use of a courier or by such other means in order to place the card in the possession of the intended recipient.

Another means by which to deliver cards is to simply affix the card to the top surface or uppermost portion of the sheet of paper or the like. A still further solution was to create a calendared area or recess in the paper substrate that was to become the card carrier, by crushing an area of the paper that corresponded to the size of the card. Then place the card within the substrate. A still further option to the inclusion of the card on the surface of the paper or substrate, was for the manufacturers to create holes, pockets or die cut areas in a substrate that corresponded in size and shape to the card that was to be placed into the receiving area.

However, while the carrier may have had many iterations in delivering a card to a user or a recipient, often times the structure of the card itself may have been overlooked and may have contributed to some of the problems faced by card issuers and card holders alike.

Cards sometimes however can be slippery and difficult to grasp. This may be due to the common practice of manufacturing such cards from plastic materials which may then slip from the users hand or cause the user to fumble with the card when attempting to place or position the card in key slot. This can be a frustrating experience, particularly for example, if a tired traveler is attempting to access the hotel room or an anxious guest is quickly trying to get into a membership club. This problem can be further complicated if the user's hand is sweaty or if the individual may have contacted some substance which may be slick.

What is needed therefore is a card product that has various indentations positioned around the perimeter of the card such that the card can be easily and readily grasped by the hand of a user.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Surprisingly it has been found that by cutting small indentations in a particular, pre-determined pattern around the periphery of a card, a card product, such as a retail/hospitality type card can be created so that it is easily graspable by the human hand which thusly allows a user to readily manipulate the card so that it can be positioned for use in a key or entry slot.

In one exemplary embodiment of the present invention, a wallet sized card, is described and includes a card having first and second surfaces, first and second transversely extending end edges and first and second longitudinally extending sides. Printed indicia is applied to at least the first face of the card.

A first indentation that has a width is disposed inwardly of the first longitudinally extending side and first and second indentations each having a width are disposed inwardly of the second longitudinally extending side. These indentations are spaced from one another at least a distance equal to the width of one of the first and second indentations. The first and second indentations in the second longitudinally extending side are linearly offset from the first indentation in the first longitudinally extending side.

Continuing with a description of the presently described embodiment, the first transversely extending edge has first and second indentations each of which have a substantially equivalent width and are disposed inwardly of the edge and spaced from one another a distance substantially equal to the width of one of the indentations. Each of the first and second indentations of the second longitudinally extending side and the first and second indentations of the first transversely extending edge are sized and configured so as to be able to accommodate a human digit.

In a still further exemplary embodiment of the present invention, a substantially planar, semi-rigid, rectangular shaped substrate, is described and includes a substrate that has width that is less than four inches and a length that is less than three inches and having first and second surfaces, first and second transversely extending end edges and first and second longitudinally extending sides. Printed indicia is applied to at least the first face of the substrate.

A first indentation that has a width is disposed inwardly of the first longitudinally extending side and first and second indentations each having a width are disposed inwardly of the second longitudinally extending side and are spaced from one another at least a distance equal to the width of one of the first and second indentations. The first and second indentations in the second longitudinally extending side are linearly offset from the first indentation in the first longitudinally extending side. The first transversely extending edge has first and second indentations each having a substantially equivalent width and each are disposed inwardly of the edge and spaced from one another a distance substantially equal to the width of one of the indentations. The second transversely extending edge has first and second indentations each of which have a substantially equivalent width and are disposed inwardly of the edge and are spaced from one another a distance substantially equal to a width of one of the indentations.

Continuing with a description of the presently described embodiment, the first indentation of the first longitudinally extending side and the first and second indentations of the first and second transversely extending edges extend inwardly a distance that is substantially equivalent to one another.

In a yet still further embodiment of the present invention, wallet card carrier combination is described and includes a card that has first and second surfaces, first and second transversely extending end edges and first and second longitudinally extending sides. The card has printed indicia that is applied to at least the first face.

A first indentation that has a width is disposed inwardly of the first longitudinally extending side and first and second indentations each having a width are disposed inwardly of the second longitudinally extending side and are spaced from one another at least a distance equal to the width of one of the first and second indentations. The first and second indentations in the second longitudinally extending side are linearly offset from the first indentation in the first longitudinally extending side.

The first transversely extending edge has first and second indentations each having a substantially equivalent width and each of which are disposed inwardly of the edge and are spaced from one another a distance substantially equal to the width of one of the indentations.

The presently described embodiment further includes a carrier that has first and second longitudinally extending sides, first and second transversely extending edges, top and bottom surfaces. The carrier further including a card retention means for holding the card.

Each of the foregoing embodiments include indentations that are sized to accommodate digits of the human hand including the thumb and fingers and extend inwardly of the periphery of the card and are spaced from one another in an amount approximately equal to half of the width of the indentation.

The card and carrier may be printed with matching information, including graphical depictions and the carrier may be printed with personalized information that is specifically printed and tailored to the anticipated recipient or guest of the establishment or club.

These and other objects of the invention will become clear from an inspection of the detailed description of the invention and from the appended claims.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

The present invention is now illustrated in greater detail by way of the following detailed description which represents the best presently known mode of carrying out the invention. However, it should be understood that this description is not to be used to limit the present invention, but rather, is provided for the purpose of illustrating the general features of the invention.

Surprisingly, it has been discovered that a card with improved graspable characteristics can be created by providing a series of strategically spaced indentations or recesses in the perimeter of a card or semi-rigid substrate.

The term "personalized information" refers to information that is printed or imaged onto a substrate, which is generally variable or unique and which may change from document to document or segment to segment, so as to create a customized message or communication for each recipient. Examples of personalized information may include names, addresses, descriptions, plans, coding, numbering, promotional text, etc. that may have been acquired from the intended recipient through surveys, questionnaires or answers given to various inquiries generated in response to a request for goods or services.

The term "static or fixed" information refers to printed or imaged information that generally does not change from document to document or segment to segment and may include a general description or body of information about particular products, services, places, etc. that may be of interest to the intended recipient and represents a standard message that the manufacturer or supplier wishes to convey to an end user or customer of the offering.

Figure 1:
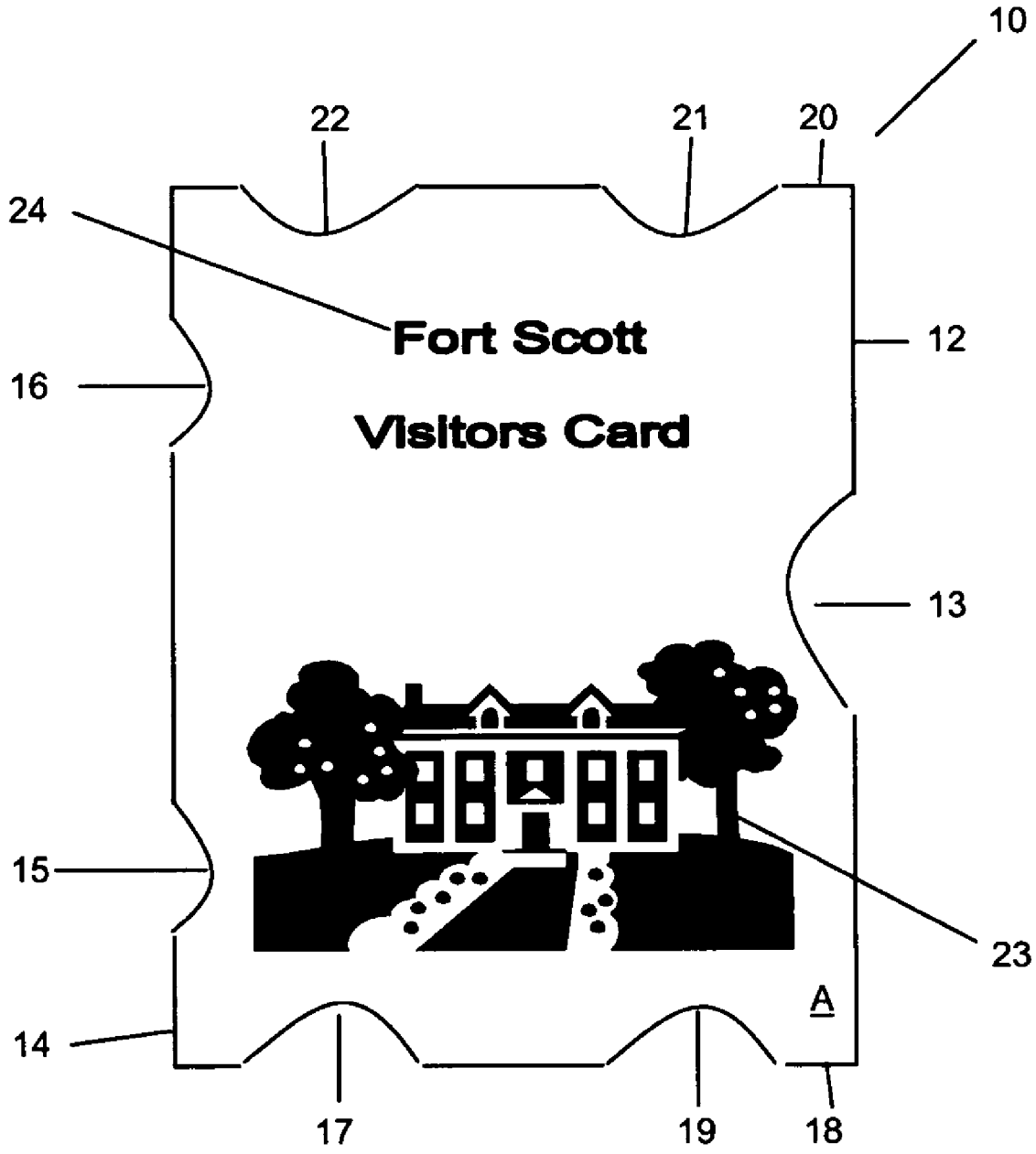
FIG. 1 depicts a front view of the card prepared in accordance with the present invention.

Turning now to FIG. 1 of the presently described exemplary embodiment, a substantially planar, semi-rigid, rectangular substrate or card is generally depicted by reference to numeral 10. The exemplary wallet sized card has a width of about three and a half inches to about three and three eighth inches and a length of about two and a quarter inches to about two and one eighth inches. The card 10 includes a first face "A" and a second face (not shown) which represents the reverse side of the card. The card 10 has first and second longitudinally extending sides 12 and 14 and first and second transversely extending edges 18 and 20.

The first longitudinally extending side 12 is provided with first indentation 13 which has a width of approximately three quarters of an inch and a depth of about one eighth of an inch. The indentation 13 is preferably provided about midway down the length of the first longitudinally extending side 12.

The second longitudinally extending side 14 has first and second indentations 15 and 16 that have a width of about one half of an inch and a depth of ranging from about one sixteenth of an inch to about one eighth of an inch. The indentations 15 and 16 are spaced from one another by approximately the width of one the indentations, that is about one half of an inch.

The card 10 has first and second transversely extending edges 18 and 20. The first transversely extending edge is provided with first and second indentations 21 and 22 and the second transversely extending edges 18 is provided with first and second indentations 17 and 19. Each of the indentations on the transversely extending edges 17, 19, 21 and 22 have a width of about one half of an inch and a depth ranging from about one sixteenth of an inch to about one eighth of an inch. The indentations 17 and 19 and 21 and 22 are spaced from one another a length substantially equivalent to the width of the indentations that is about one half of an inch to about three quarters of an inch.

The face "A" of the card 10 is provided with static or fixed printing 24 as well as graphical representations 23 which may be used to depict the area for which the card 10 is intended to be used.

As can be seen from the drawing in FIG. 1, the indentation 13 on the first longitudinally extending sides 12 is linearly offset from the indentations 15 and 16 in the second longitudinally extending side 14. That is, if one were to draw a line from the center of the indentation 13 and the line ran parallel to the top and bottom transversely extending edges 18 and 20, the line would bisect the area between indentations 15 and 16 approximately, centrally of the space between the indentations.

The first indentation 13 in the first longitudinally extending side 12 is approximately centrally disposed along side 13. The indentations 15 and 16 are positioned such that one indentation appears in each half of the side 14.

The first and second indentations 21 and 22 of the transversely extending edge 20 are in substantial linear alignment with first and second indentations 17 and 19 of transversely extending side 18. That is, if one were to draw lines from the center of each of the indentations 17 and 19 and the lines ran parallel to the longitudinally extending sides 12 and 14 then the lines would intersect indentations 21 and 22 at approximately the central point of each of the indentations.

It should also be understood that other adaptations for the card products may be possible, such as having rounded edges on one or more corners of the card, additional indentations on the edges of the card and different spacing and sizing of the indentations to achieve other effects. In addition, the card may also be provided with holes in the body of the card and such other aesthetic features as the manufacturer, customer or end user may desire.

Figure 2:
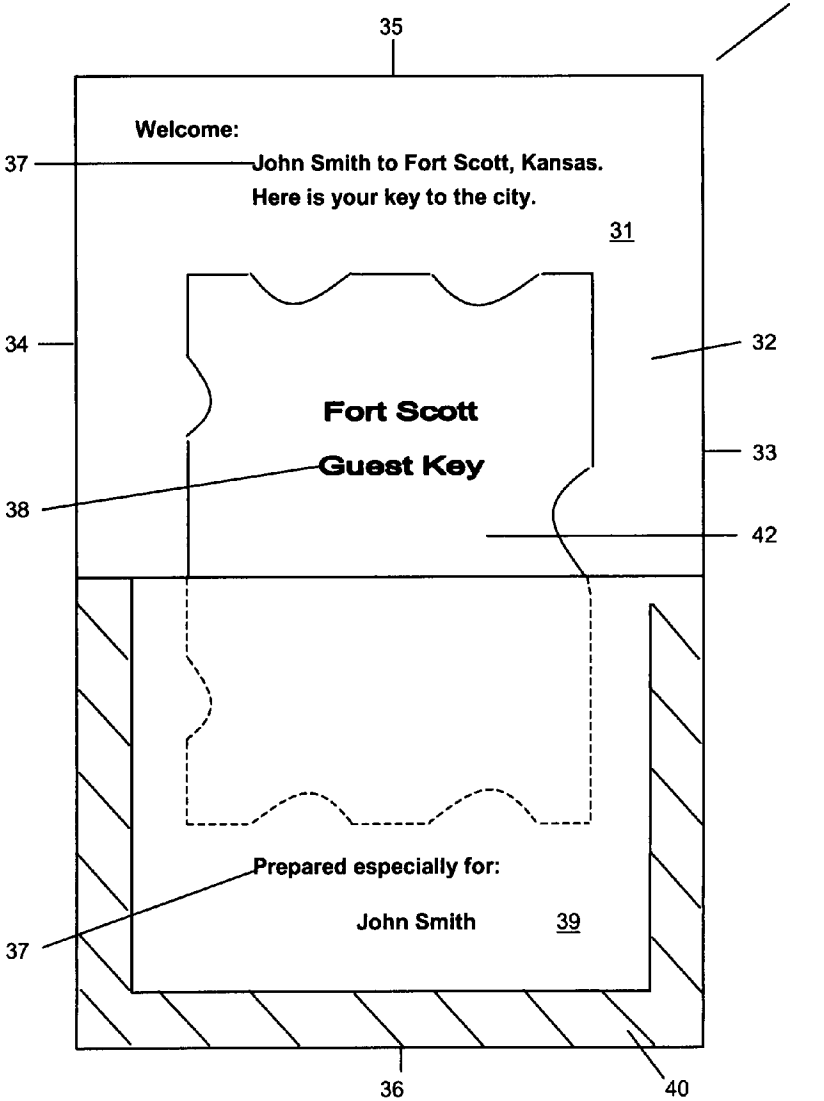
FIG. 2 presents a card carrier combination prepared in accordance with the present invention and showing a pocketed configuration.

Reference is now directed to FIG. 2 which shows a further exemplary embodiment of the presently described invention. In this embodiment, a card carrier, generally depicted by reference to numeral 30 is shown. The card carrier 30 will preferably be constructed of a printable material, one that can easily be fed through a printer, and more likely than not the carrier 30 will be manufactured from an economical material such as paper. However, other materials are also suitable including synthetic film and metal foils.

The carrier 30 includes first and second longitudinally extending sides 33 and 34, and first and second transversely extending edges 35 and 36. As can be seen from the FIGURE, the carrier 30 is generally depicted in a rectangular shape but it should however be understood that the carrier can take any shape that a customer may desire including other geometric shapes and configurations of animate and inanimate objects.

The carrier 30 has a first face 31 and a second face (not shown in FIG. 2) which is on the opposite side of the carrier 30. The carrier 30 is shown with personalized printing which is represented by numerical reference 37 and static printing represented by 38. The carrier 30 includes a pocket 39 that is created in the presently described embodiment by adhering a paper sheet that is smaller than the carrier onto the carrier 30 through use of a U shaped pattern of adhesive 40. The pocket 39 is sized and configured so as to accommodate a card 42. The card 42 can contain printing 38 that is complimentary to personalized printing 37 such that a common theme can be communicated to a prospective recipient on both the card 42 and the carrier 30.

Figure 3:
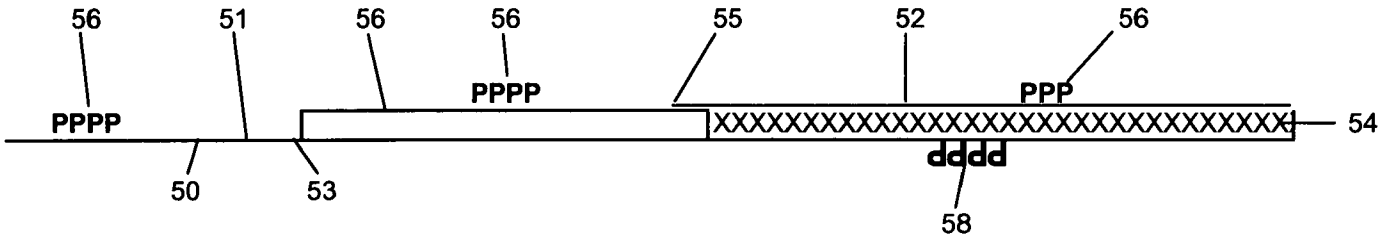
FIG. 3 provides a side view of the card carrier shown in FIG. 2.

Attention is now directed to FIG. 3 which illustrates a side, cross sectional view of the carrier 30 shown in FIG. 2. In the presently described FIG. 3, the carrier is designated by numeral 50, which has a top face 51 and a bottom face 53. A pocket is formed by adhering a sheet 52 that is smaller than the carrier sheet 50, to the carrier sheet 50 by a pattern of adhesive 54. The adhesive may be applied in a continuous pattern to form a U shape or alternatively, the pattern may be applied as a series of dots, lines, segments, strips, spots, etc. that are sufficient to at least tack or adhere the upper sheet 52 to the carrier sheet 50.

A card 56, as has been previously described has been inserted into an opening 55 that is created when the U shape pattern of adhesive 54 leaves the upper sheet 52 unsecured along one edge so that the card can be easily inserted and removed from the pocket created on the carrier sheet. Printing, represented by numeral 56 is applied to the top of the pocket sheet 52, the card surface 56 and the carrier 50 first face 51. In addition, printing 58 may be applied to the back or second surface 53 of the carrier 50 in the event additional printing space is needed to complete the instructions on use of the card or alternatively to provide additional information to the recipient.

Figure 4:
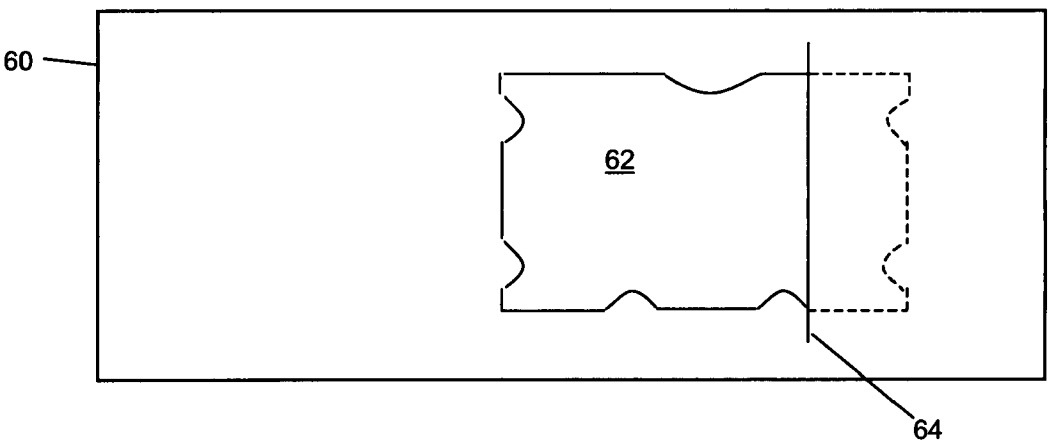
FIG. 4 illustrates an alternative configuration of a card carrier combination.

FIG. 4 is provided to show a further alternate carrier embodiment, in which a carrier 60 is provided with a card 62 that has been inserted into a slit or cut 64 in the carrier 60. In this fashion, the manufacturer does not need to form a pocket in the assembly and instead by providing a slit that is slightly larger than the width of the card, approximately two and a half to three inches. When the card 62 is inserted, a portion of the card front face, shown in phantom, will be in contact with the back or second surface of the carrier 60.

Figure 5:
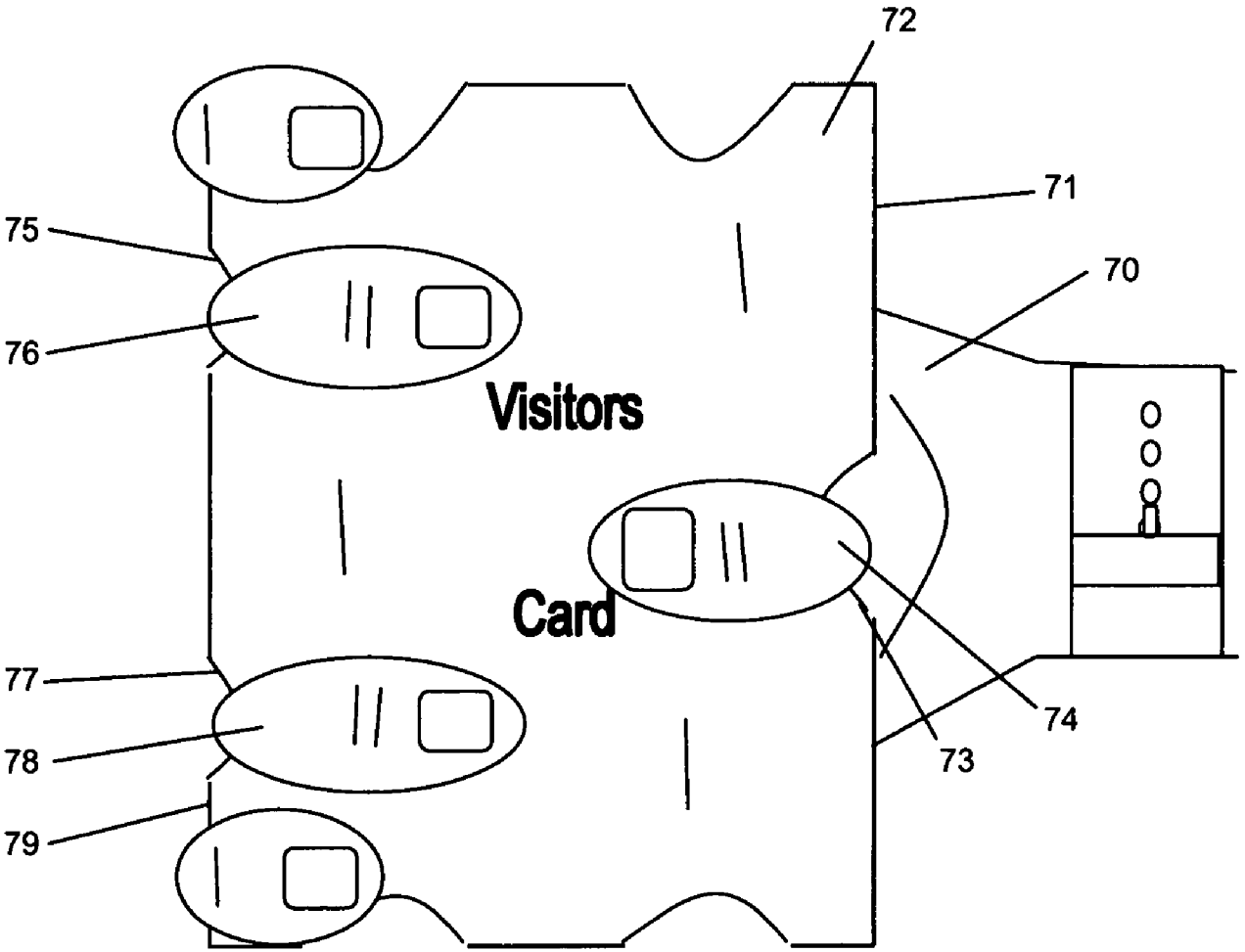
FIG. 5 shows a graspable card configuration.

Reference is now directed at FIG. 5 of the present invention in which a hand 70 is shown grasping a card 72 through use of the indentations and digits of the hand. The first indentation 73 appearing on longitudinally extending side 71 is grasped, in this example by the human thumb 74. The indentation 73 as described above is sized so as to generally be able to accommodate the width of the thumb where as the other indentations are smaller so as to more comfortably and securely grasp the indentations on the opposite side of the card 72.

The first and second indentations 75 and 77 on the second longitudinally extending side 79 are grasped by the middle two fingers, in this example, by the human hand 76 and 78. In this way, with the thumb and middle two fingers grasping the sides of the card, the card can be held securely by the hand and manipulated to be inserted in a key slot or other device for example to gain entry to a building or room.

By providing such a uniquely positioned configuration of indentations in the sides of the card assembly, the card can be easily and readily removed from a carrier, if one is provided, and the foregoing drawbacks of having a card that is difficult to grasp and manipulate as with prior art card products is overcome.

While the present example contemplates the use of the thumb and two middle fingers of the hand, it should be understood that other combinations of fingers may be used to securely hold the card or alternatively, one may not need to utilize all of the indentations that have been provided in the card.

It will thus be seen according to the present invention a highly advantageous card and card carrier combination has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

The invention claimed is:

1. A wallet sized card, comprising;

a card having first and second surfaces, first and second transversely extending end edges and first and second longitudinally extending sides;

printed indicia is applied to at least said first face;

a first indentation having a width is disposed inwardly of said first longitudinally extending side and first and second indentations each having a width are disposed inwardly of said second longitudinally extending side and are spaced from one another at least a distance equal to said width of one of said first and second indentations, said first and second indentations in said second longitudinally extending side are linearly offset from said first indentation in said first longitudinally extending side;

said first transversely extending edge having first and second indentations each having a substantially equivalent width and disposed inwardly of said edge and spaced from one another a distance substantially equal to said width of one of said indentations; and wherein each of said first and second indentations of said second longitudinally extending side and said first and second indentations of said first transversely extending edge are sized and configured so as to be able to accommodate a human digit.

2. A wallet sized card as recited in claim 1, wherein said second surface is printed with textual information.

3. A wallet sized card as recited in claim 1, wherein said printed indicia includes graphical depictions.

4. A wallet sized card as recited in claim 1, wherein said first and second indentations are linearly offset from said first indentation in said first longitudinally extending side a distance equal to about half of said width of said first indentation.

5. A wallet sized card as recited in claim 1, wherein each of said first indentation of said first longitudinally extending side is sized and configured to accommodate a human thumb.

6. A walled sized card as recited in claim 1, wherein said second transversely extending edge has first and second indentations each having a substantially equivalent width disposed inwardly of said edge and spaced from one another a distance substantially equal to a width of one of said indentations.

7. A wallet sized card as recited in claim 6, wherein said first and second indentations in said first transversely extending edge are substantially linearly aligned with said first and second indentations in said second transversely extending edge.

8. A wallet sized card as recited in claim 1, wherein a thermally sensitive material is applied over said first surface of said card to create a changeable medium upon exposure to heat.

9. A wallet sized card as recited in claim 1, wherein each of said indentations in each of said first and second longitudinally extending sides extends inwardly a distance that is substantially equal.

10. A wallet sized card as recited in claim 6, wherein each of said indentations in said first transversely extending side and each of said indentations in said second transversely extending side extend inwardly a distance that is substantially equal.

11. A substantially planar, semi-rigid, rectangular shaped substrate, comprising;

a substrate having width less than four inches and a length less than three inches and having first and second surfaces, first and second transversely extending end edges and first and second longitudinally extending sides;

printed indicia is applied to at least said first face;

a first indentation having a width is disposed inwardly of said first longitudinally extending side and first and second indentations each having a width are disposed inwardly of said second longitudinally extending side and are spaced from one another at least a distance equal to said width of one of said first and second indentations, said first and second indentations in said second longitudinally extending side are linearly offset from said first indentation in said first longitudinally extending side;

said first transversely extending edge having first and second indentations each having a substantially equivalent width and disposed inwardly of said edge and spaced from on another a distance substantially equal to said width of one of said indentations said second transversely extending edge has first and second indentations each having a substantially equivalent width disposed inwardly of said edge and spaced from one another a distance substantially equal to a width of one of said indentations; and wherein said first indentation of said first longitudinally extending side and said first and second indentations of said first and second transversely extending edges extend inwardly a distance that is substantially equivalent to one another.

12. A substantially planar, rectangular shaped substrate as recited in claim 11, wherein each of said indentations are approximately equal in size.

13. A substantially planar, rectangular shaped substrate as recited in claim 11, wherein said second face of said substrate is provided with printed indicia.

14. A wallet card carrier combination, comprising;

a card having first and second surfaces, first and second transversely extending end edges and first and second longitudinally extending sides;

printed indicia is applied to at least said first face;

a first indentation having a width is disposed inwardly of said first longitudinally extending side and first and second indentations each having a width are disposed inwardly of said second longitudinally extending side and are spaced from one another at least a distance equal to said width of one of said first and second indentations, said first and second indentations in said second longitudinally extending side are linearly offset from said first indentation in said first longitudinally extending side;

said first transversely extending edge having first and second indentations each having a substantially equivalent width and disposed inwardly of said edge and spaced from one another a distance substantially equal to said width of one of said indentations; and a carrier having first and second longitudinally extending sides, first and second transversely extending edges, top and bottom surfaces, said carrier further including a card retention means for holding said card.

15. A wallet card carrier combination as recited in claim 14, wherein said card retention means includes a sheet of material having four edges and a size less than said carrier, said sheet of material is adhered to said carrier by a U shaped pattern of adhesive that is provided along three of said four edges and adjacent one of said first and second transversely extending edges and said first and second longitudinally extending sides of said carrier.

16. A wallet card carrier combination as recited in claim 14, wherein said card retention means includes a slit disposed between said first and second longitudinally extending sides of said carrier.

17. A wallet card carrier combination as recited in claim 14, wherein said card is placed on said carrier such that said indentations of each of said first and second longitudinally extending sides exposed such that each of said indentations are graspable by a digits of a human hand.

18. A wallet card carrier combination as recited in claim 14, wherein said carrier includes printed indicia that matches said printed indicia on said first face of said card.

19. A wallet card carrier combination as recited in claim 14, wherein said carrier includes personalized information.

20. A wallet card carrier combination as recited in claim 14, wherein said card has dimensions of approximately two and a half inches by approximately three and a half inches and said carrier is larger than said card.

* * * * *